US008584584B2

(12) United States Patent
Kasper et al.

(10) Patent No.: US 8,584,584 B2
(45) Date of Patent: Nov. 19, 2013

(54) NONCONTACT WEB STABILIZER

(75) Inventors: Kent Dirksen Kasper, Dover, NH (US); Drew Edwin Kiefaber, Newmarket, NH (US); Daniel Matthew Perdue, Rochester, NH (US)

(73) Assignee: Goss International Americas, Inc., Durham, NH (US)

( * ) Notice: Subject to any disclaimer, the term of this patent is extended or adjusted under 35 U.S.C. 154(b) by 1824 days.

(21) Appl. No.: 11/360,294

(22) Filed: Feb. 23, 2006

(65) Prior Publication Data

US 2007/0193457 A1 Aug. 23, 2007

(51) Int. Cl.
*B41F 13/56* (2006.01)
*B65H 20/00* (2006.01)

(52) U.S. Cl.
USPC ..... 101/225; 101/218; 226/97.3; 242/615.11

(58) Field of Classification Search
USPC ..... 101/218, 225, 247; 226/97.3; 242/615.11
See application file for complete search history.

(56) References Cited

U.S. PATENT DOCUMENTS

| | | | | |
|---|---|---|---|---|
| 3,650,043 | A | 3/1972 | Overly et al. | |
| 3,976,237 | A | 8/1976 | Bossons | |
| 5,901,648 | A | 5/1999 | Roland et al. | |
| 5,924,619 | A | 7/1999 | Bartell | 226/7 |
| 5,967,457 | A | 10/1999 | Wildenberg et al. | |
| 6,216,592 | B1 | 4/2001 | Knauer et al. | 101/247 |
| 6,986,305 | B2 | 1/2006 | Knauer | |
| 2003/0066450 | A1 | 4/2003 | Senoo et al. | |

FOREIGN PATENT DOCUMENTS

| | | | |
|---|---|---|---|
| FR | 2519298 | A | 7/1983 |
| GB | 1587497 | A | 4/1981 |

*Primary Examiner* — Ren Yan
(74) *Attorney, Agent, or Firm* — Davidson, Davidson & Kappel, LLC

(57) ABSTRACT

A noncontact web stabilizer is provided in which members located on opposite sides of a web reduce out-of-plane web vibrations. Specifically, a first member is located on one side of a web and a second member is located on the opposite side of the web. Both members are positioned so that the distance between the web and the members decrease in the direction that the web is moving, creating opposing regions of high pressure that force the web toward its nominal running position, thereby reducing out-of-plane web instability.

15 Claims, 5 Drawing Sheets

NONCONTACT WEB STABILIZER

BACKGROUND

The present invention relates to printing presses and more particularly to a web stabilization apparatus.

In a web fed rotary printing press having multiple printing units, it may be desired to stop printing one or more printing units by throwing the blanket cylinders away from the web. This can permit, for example, a plate or blanket change. Automatic plate changes can occur using an automatic transfer printing unit. Such a printing press is for example manufactured by Goss International as the Sunday 2000 Autotransfer Press.

When the blanket cylinders are separated from the web, the web can pass freely between the two blanket cylinders. As the web passes between the separated blanket cylinders the web may demonstrate out-of-plane vibrations. More specifically, these out-of-plane vibrations occur when the auto transfer unit blankets are off impression and when the web is passing through at normal printing speeds.

When the web experiences out-of-plane vibrations, unintentional web contact can occur with the blanket cylinders. Unintentional web contact with the blanket cylinders could result in print defects on the web or web breakage. It is known in the printing industry to use rollers located upstream and downstream from a printing unit in an attempted to stabilize a moving web. However, rollers can produce marking or damage to the web. U.S. Pat. No. 5,924,619 describes an apparatus for passing a printed web between separated cylinders of a deactivated printing unit.

Referring to FIG. 1A, a prior art printing press 100 is shown with a web 110 and without a web stabilization device. Printing press 100 has printing units 105-1 through 105-*a*, where a is a predetermined value, preferably 5 or 8 for an automatic transfer press with 5 units having two black printing units and 8 having two printing units each for magenta, cyan, yellow and black. The printing units 105-1 through 105-*a* each have 4 cylinders, 2 blanket cylinders, 2 plate cylinders and 2 automatic plate changers. Printing unit 105-1 has blanket cylinders 115-1*a,b*, plate cylinders 120-1*a,b*, and automatic plate changers 160-1*a,b*. Print unit 105-2 has blanket cylinders 115-2*a,b* and plate cylinders 120-2*a,b*, where all 4 cylinders are rolling without contact, which can permit, for example, automatic plate transfer by automatic plate changers 160-2*a,b*. As shown in FIG. 1(*a*), as web 110 moves in the direction denoted by arrow 125, web 110 experiences out-of-plane vibrations (denoted by arrow 130) where unintentional web contact can occur with blanket cylinders 115-2*a,b*.

FIG. 1B shows the prior art printing press 100 of FIG. 1A with rollers 130-*a* and 130-*b* located upstream and downstream from printing unit 105-2 which is off impression. Web 110 runs over roller 130-*a* and under 130-*b* in an attempt to provide out-of-plane web stability. The problem with this configuration is that rollers 130-*a,b* can produce unacceptable damage to web 110, such as such as damage to the wet printed surface and web breakage.

FIG. 1C shows the prior art printing press 100 of FIG. 1A with rollers 140-*a* and 140-*b* located upstream and downstream from the deactivated printing unit 105-2, in an attempt to provide out-of-plane web stability. In FIG. 1(*c*), the cylinders of print unit 105-2 are inclined away from the vertical angle by an angle of inclination, for example, of 10 to 15 degrees. Like in FIG. 1(*b*), web 110 runs over roller 140-*b* and under roller 140-*b* in an attempt to stabilize moving web 110.

As mentioned above, rollers 140-*a,b* can produce unacceptable damage to web 110, such as damage to the wet printed surface and web breakage.

SUMMARY OF THE INVENTION

In accordance with an embodiment of the present invention, a web automatic transfer print unit includes a first plate cylinder, a first blanket cylinder, a second blanket cylinder, a second plate cylinder, and a first and second member. The members are located on opposite sides of a web. The first member is positioned so that the distance between the web and the first member decreases in the direction that the web is moving. The second member is positioned so that the distance between the web and the second member decreases in the direction that the web is moving.

Figure 1A:
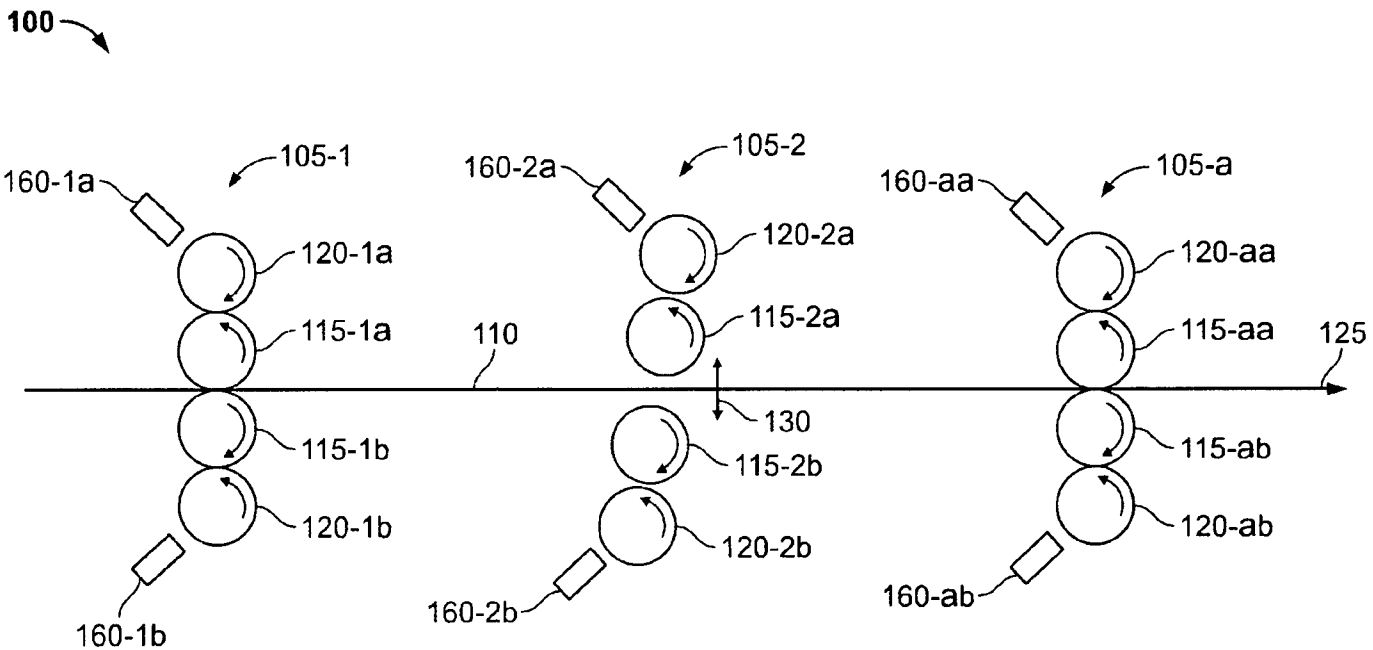
FIG. 1A (Prior Art)
FIG. 1A, illustrates a prior art automatic transfer printing press having multiple printing units without stabilizing a web.
Figure 1B:
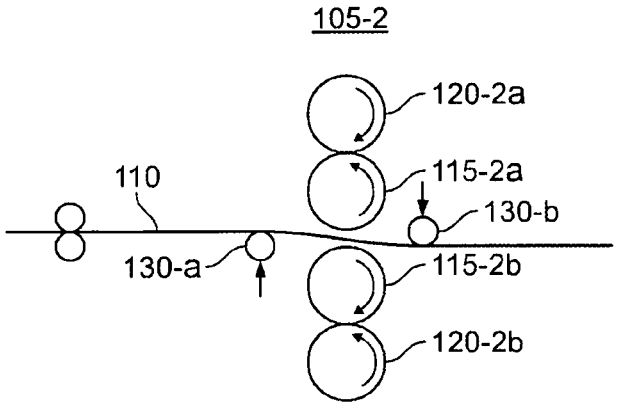
FIG. 1B (Prior Art)
FIGS. 1B and 1C illustrate prior art rollers for stabilizing a web in an automatic transfer unit.
Figure 1C:
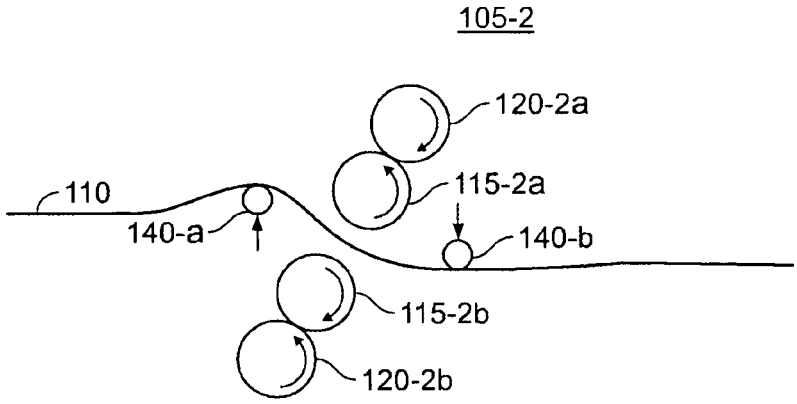
FIG. 1C (Prior Art)
Figure 2:
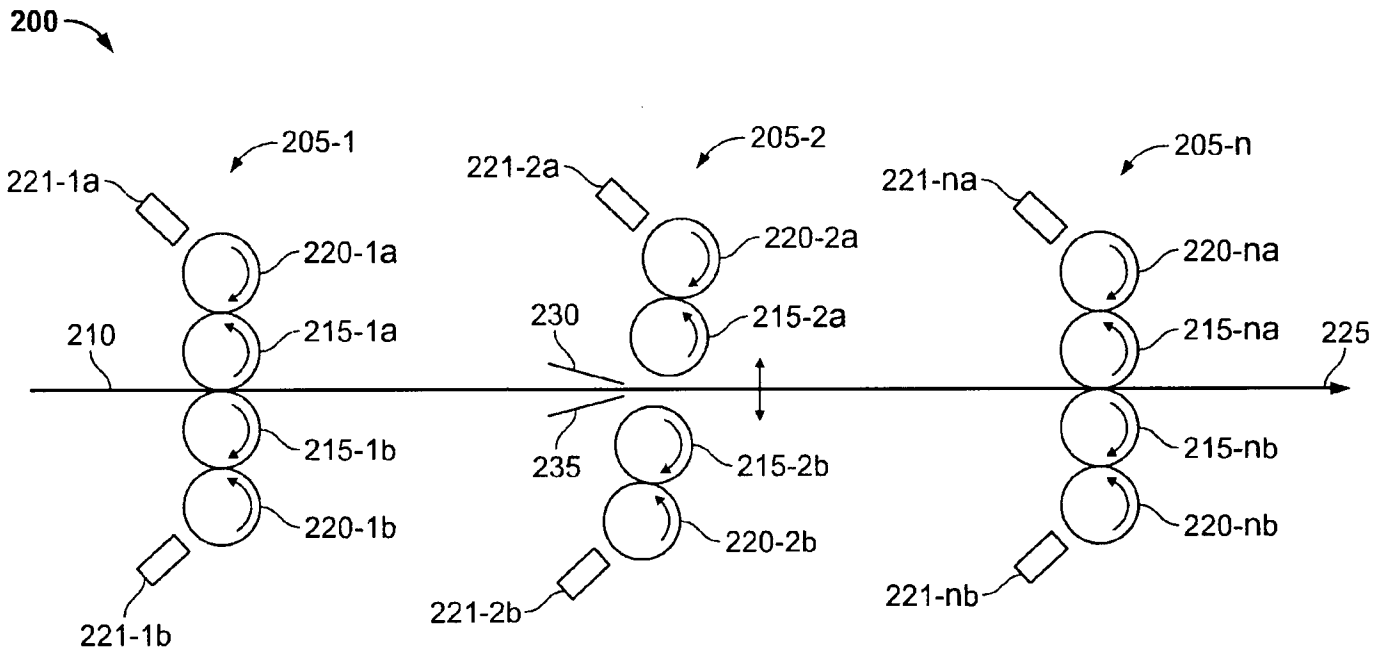
Figure 3:
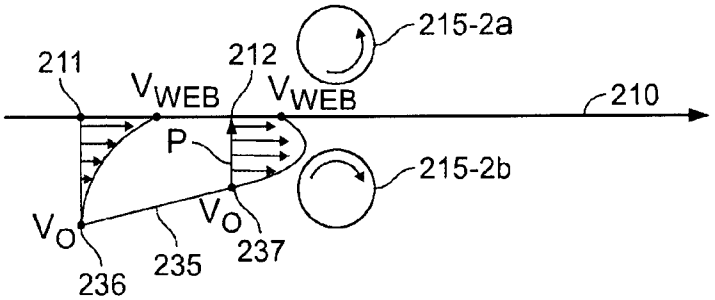
Figure 4:
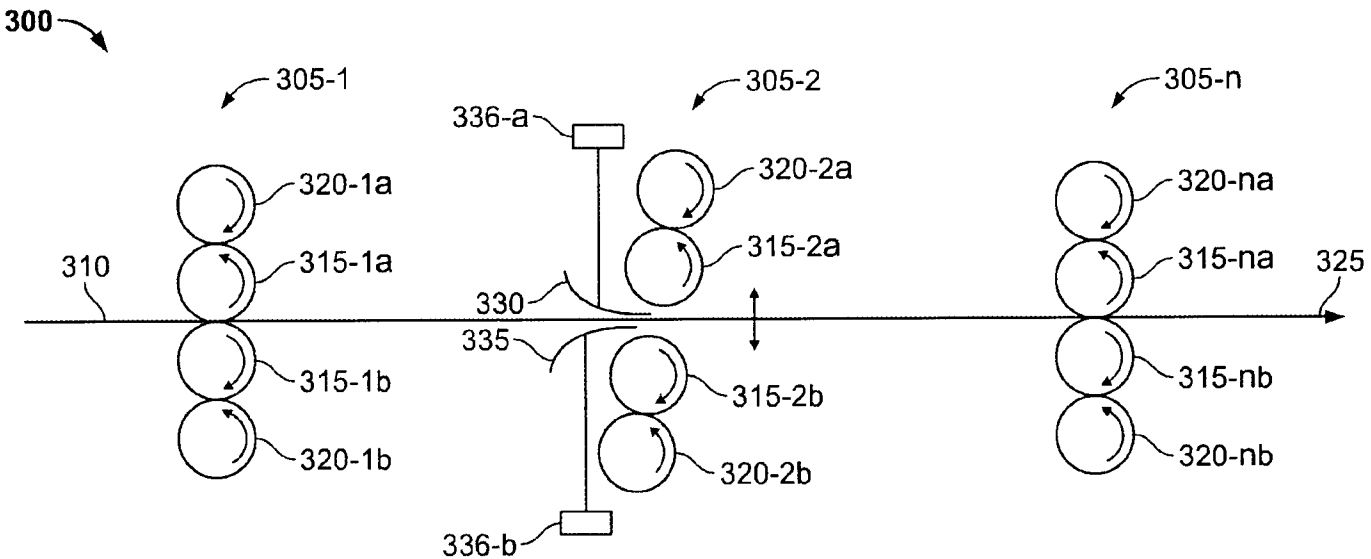
Figure 5:
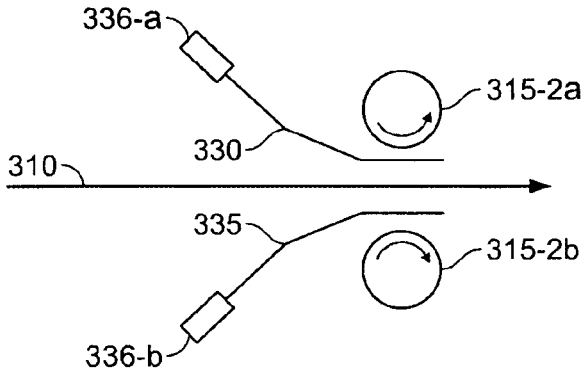
Figure 6:
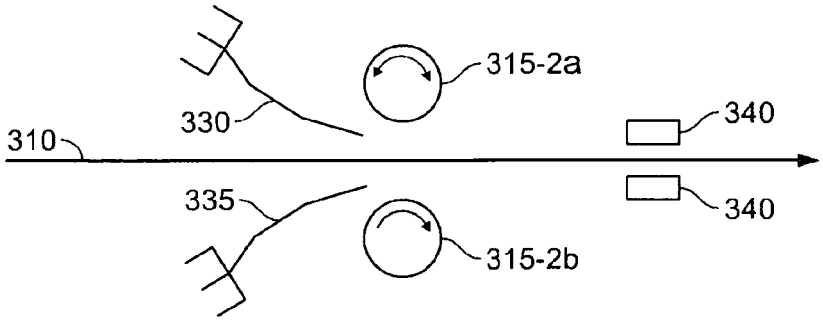

Further objects, features and advantages of the invention will become apparent from the following detailed description taken in conjunction with the accompanying drawings, in which:

FIG. 2 illustrates a printing press with noncontact stabilizers 230, 235 in accordance with an embodiment of the present invention;

FIG. 3 illustrates general air velocity profiles and pressures in accordance with an embodiment of the invention;

FIG. 4 a printing press with noncontact stabilizers 330, 335 in accordance with a further embodiment of the present invention;

FIG. 5 illustrates noncontact stabilizers 330, 335 positioned past the center-line of the blanket cylinders in accordance with a further embodiment of the present invention; and FIG. 6 illustrates noncontact stabilizers 330, 335 in accordance with a further embodiment of the present invention.

DETAILED DESCRIPTION

In accordance with embodiments of the present invention, a noncontact web stabilization apparatus is provided. In accordance with the embodiments of the present invention, the noncontact web stabilization apparatus causes changes in air pressure to provide out-of-plane web stability.

FIG. 2 illustrates the printing press of the present invention with noncontact stabilizers 230 and 235 for improving out-of-plane web stability of moving web 210. As shown in FIG. 2, a printing press 200 has print units 205-1 through 205-*n*, where n is a predetermined value. Each print unit 205-1 through 205-*n* is shown with 4 cylinders: blanket cylinders 215-1 *a,b* through 215-*na,b* and plate cylinders 220-1*a,b* through 220-*na,b*.

As show in FIG. 2, print units 205-1 and 205-*n* have all four cylinders rolling and blanket cylinders 215-1*a,b* and 215-*na,b* in contact with web 210. In contrast, print unit 205-2 has blanket cylinders 215-2*a,b* and plate cylinders 220-2*a,b* rolling without contact with web 210. Web 210 moves from print unit 205-1 to print unit 205-*n* in the direction denoted by arrow 225. Web 210 passes between print unit 205-1 and through noncontact stabilizers 230 and 235 before passing through print unit 205-2, without experiencing out-of-plane vibrations and without contacting blanket cylinders 215-2*a* and 215-2*b* in accordance with an embodiment of the present invention. Each print unit can have an automatic plate change unit 221-1*a,b* through 221-*na,b*.

In this particular embodiment of the present invention, noncontact stabilizers 230 and 235 are rigid plates, for example made of metal, that are positioned on both sides of web 210. Preferably, noncontact stabilizers 230 and 235 are as wide as, or wider than, web 210, but do not have to be as wide as web 210. Noncontact stabilizers 230 and 235 are positioned before the blanket-to-blanket nip of blanket cylinders 215-2*a* and 215-2*b*. Noncontact stabilizers 230 and 235 are also tilted so that the distance between web 210 and noncontact stabilizers 230 and 235 decreases in the direction that web 210 travels, as shown in FIG. 2. The decreasing gap between web 210 and noncontact stabilizer 230 creates a high pressure on the top side of web 210. Similarly, the decreasing gap created between web 210 and noncontact stabilizer 235 creates a high pressure on the bottom side of web 210 which balances the pressure created by noncontact stabilizer 230 located on the opposite side of web 210. The opposing pressures created by noncontact stabilizers 230 and 235 prevent out-of-plane vibrations of web 210 and stabilizes web 210 as it passes through print unit 205-2. Further, as web speed increases, the opposing pressures created by noncontact stabilizers 230 and 235 increase, thus providing greater stabilization of web 210.

For example, FIG. 3 shows the air velocity profiles of air entering and exiting noncontact stabilizer 235. At the entrance, air at the tip 236 is at zero velocity due to the no slip boundary condition, while air at the web, is traveling at web speed $V_{web}$, due to the same boundary condition. At point 211 an air velocity profile as shown is created. At tip 237, the air velocity is also zero, while the air velocity at point 212 is also $V_{web}$. Since, however, the exit distance between tip 237 and the web 210 has decreased, a bulge velocity profile may occur at the exit of noncontact stabilizer 235 to satisfy the physical law of conservation of momentum. A pressure P will result due to the bulge profile, even if some air escapes sideways By placing a similar device 230 on the opposite side of the web, two high pressure regions are created, one on either side of the web, which together force the web into an equilibrium position thereby eliminating the undesired out of plane vibration.

FIG. 4 illustrates noncontact stabilizers 330 and 335 embodying the principles of the present invention for improving out-of-plane web stability of moving web 310, in accordance with another embodiment of the present invention. As shown in FIG. 4, a printing press 300 has print units 305-1 through 305-*n*, where n is a predetermined number. For the purpose of clarity, each print unit 305-1 through 305-*n* is shown with 4 cylinders: blanket cylinders 315-1*a,b* through 315-*na,b*, plate cylinders 320-1*a,b* through 320-*na,b* and actuators 336-*a,b*.

FIG. 4 shows that print units 305-1 and 305-*n* each have all four cylinders rolling and blanket cylinders 315-1*a,b* and 315-*na,b* in contact with web 310. In contrast, print unit 305-2 has blanket cylinders 315-2*a,b* and plate cylinders 320-2*a,b* rolling without contact with web 310. Web 310 moves from print unit 305-1 to print unit 305-*n* in the direction denoted by arrow 325. As shown in FIG. 4, web 310 passes between print unit 305-1 and through stabilizers 330 and 335 before passing through print unit 305-2, without experiencing out-of-plane vibrations and without contacting blanket cylinders 315-2*a* and 315-2*b*, in accordance with the present invention.

In this particular embodiment of the present invention, noncontact stabilizers 330 and 335 are sheets of material which are thin and flexible and positioned on both sides of web 310. Noncontact stabilizers 330 and 335 are configured so that the distance between web 310 and noncontact stabilizers 330 and 335 decreases in the direction that web 310 travels, as shown in FIG. 4.

Noncontact stabilizers 330 and 335 are positioned on the inlet side of blanket cylinders 315-2*a* and 315-2*b*. One end of each noncontact stabilizer 330 and 335 is moved in between web 310 and blanket cylinders 315-2*a* and 315-2*b* which improves out-of-plane web stability. Actuators 336 are used to move noncontact stabilizers 330 and 335 in and out of position. For example, when print unit 305-2 is in use and in contact with web 310, actuators 336-*a* and 336-*b* move noncontact stabilizers 330 and 335 away from blanket cylinders 315-2*a* and 315-2*b* so that blanket cylinders 315-2*a* and 315-2*b* can be clear to engage web 310. When print unit 305-2 is off impression, blanket cylinders 315-2*a* and 315-2*b* are moved away from web 310 and actuators 336-*a* and 336-*b* move noncontact stabilizers 330 and 335 in between web 310 and blanket cylinders 315-21 and 315-2*b*, as shown in FIG. 4.

Referring back to FIG. 4 when placed near blanket cylinders 315-2*a* and 315-2*b* or between web 310 and blanket cylinders 315-2*a* and 315-2*b*, the no slip boundary condition at the interface of the air and the surfaces of noncontact stabilizers 330 and 335 force the air velocity at the surfaces to go to zero. This lowers the average velocity and flow rate of air entering the nip region of blanket cylinders 315-2*a* and 315-2*b* which disrupts the destabilizing forces that would cause web 310 to vibrate out-of-plane. By disrupting the destabilizing forces, greater stabilization is provided and web 310 is able to return to its nominal running position, i.e. without out-of-plane vibrations.

Referring to FIG. 5, noncontact stabilizers 330 and 335 are positioned past the center-line of blanket cylinders 315-2*a* and 315-2*b*. Thus, this embodiment requires actuators 336-*a* and 336-*b* to move noncontact stabilizers 330 and 335 in and out of position. In FIG. 6, noncontact stabilizers 330 and 335 are positioned near the nip of blanket cylinders 315-2*a* and 315-2*b* while web 310 passes through blanket cylinders 315-2*a*, 2*b*. In this embodiment of the present invention, actuators are not needed because noncontact stabilizers 330 and 335 are fixed and outside the space between blanket cylinders 315-2*a* and 315-2*b*. Sensors 340 can be provided to measure web fluctuation and can be used to fine tune the position of the actuators in FIG. 6 to reduce fluctuations.

The surfaces of noncontact stabilizers 330 and 335 force the air velocity at the surfaces to go to zero. As mentioned above, this lowers the average velocity and flow rate of air entering the nip region of blanket cylinders 315-2*a* and 315-2*b* which disrupts the destabilizing forces that would cause web 310 to vibrate out-of-plane. By disrupting the destabilizing forces, greater stabilization is provided and web 310 is able to return to its nominal running position without out-of-plane vibrations.

The noncontact stabilizers illustrated in FIGS. 5 and 6 can be made from flexible materials, such as Mylar, paper or thin sheet metal. Preferably, the noncontact stabilizers are as wide as, or wider than, the web, but do not have to be as wide as web.

Based on the above disclosure, it is apparent that the principles of the invention can be incorporated into existing printing structures, such as guards and automatic blanket wash systems to achieve the benefits of the invention.

In addition, based on the disclosure, it is apparent that the noncontact stabilizers can be located anywhere along the web and anywhere in the printing press where out-of-plane vibrations may occur.

What is claimed is:

1. A noncontact web stabilizer comprising:

a first member located on one side of a web, the first member positioned so that the distance between the web and the first member having a planar surface angled with respect to the web decreases in the direction that the web is moving; and a second member located on an opposite side of the web, the second member positioned so that the distance between the web and the second member decreases in the direction that the web is moving;

the first and second members being adapted to prevent out-of-plane vibrations of the web without contacting the web.

2. The noncontact web stabilizer of claim 1 wherein the first member and the second member are fixed.

3. The noncontact web stabilizer of claim 1 wherein the first member and the second member are moveable.

4. The noncontact web stabilizer of claim 1 further comprising one or more actuators connected to the first member and the second member for changing the position of the first member and second member and/or for moving the first member and the second member upstream or downstream.

5. The noncontact web stabilizer of claim 1 wherein the first member and the second member are rigid.

6. The noncontact web stabilizer of claim 1 wherein the first member and the second member are flexible.

7. The noncontact web stabilizer of claim 1 wherein the first member and the second member are made from Mylar, paper, sheet metal, or other flexible material.

8. The noncontact web stabilizer of claim 1 wherein the first member and the second member are linear.

9. The noncontact web stabilizer of claim 1 wherein the first member and the second member are curved.

10. The noncontact web stabilizer of claim 1 wherein the first member and the second member are incorporated into existing press components.

11. The noncontact web stabilizer of claim 1 wherein the first member and the second member are incorporated into an existing structure.

12. The noncontact web stabilizer of claim 11 wherein the existing structure is an automatic blanket wash system.

13. The noncontact web stabilizer of claim 1 wherein the first member and the second member are as wide as the web.

14. A web offset printing press comprising:

a first plate cylinder;

a first blanket cylinder for contacting the first plate cylinder;

a second blanket cylinder for selective contact with a web passing between the second blanket cylinder and the first blanket cylinder;

a second plate cylinder for contacting the second blanket cylinder;

a first passive noncontact stabilizer located on one side of a web, the first passive noncontact stabilizer positioned so that the distance between the web and the first passive stabilizer decreases in the direction that the web is moving; and a second passive noncontact stabilizer located on an opposite side of the web, the second passive noncontact stabilizer positioned so that the distance between the web and the second passive noncontact stabilizer decreases in the direction that the web is moving.

15. The web offset printing press of claim 14 wherein the first passive noncontact stabilizer and the second passive noncontact stabilizer are positioned entirely upstream of where the second blanket cylinder selectively contacts the web.

* * * * *